US006640729B1

(12) United States Patent
Wei-Bin

(10) Patent No.: US 6,640,729 B1
(45) Date of Patent: Nov. 4, 2003

(54) PAPER PALLET FOR FOUR-WHEELED MOTORCYCLE

(75) Inventor: Chen Wei-Bin, Taipei (TW)

(73) Assignee: Merho Enterprise Company Limited, Kaohsiung Hsien (TW)

( * ) Notice: Subject to any disclaimer, the term of this patent is extended or adjusted under 35 U.S.C. 154(b) by 0 days.

(21) Appl. No.: 10/177,782

(22) Filed: Jun. 19, 2002

(51) Int. Cl.[7] ..... B65D 19/00
(52) U.S. Cl. ..... 108/51.3; 108/55.3
(58) Field of Search ..... 108/51.11, 51.3, 108/55.1, 55.3; 206/335, 386; 294/904

(56) References Cited

U.S. PATENT DOCUMENTS 3,079,876 A * 3/1963 Doane ..... 108/51.3
3,165,078 A * 1/1965 White ..... 108/51.3
5,133,453 A * 7/1992 Fritze ..... 206/335
5,501,333 A * 3/1996 Swan ..... 206/386
5,685,234 A * 11/1997 Grigsby et al. ..... 108/51.3
5,996,509 A * 12/1999 Lai ..... 108/51.3
6,006,676 A * 12/1999 Creek et al. ..... 108/55.3
6,029,582 A * 2/2000 Ogilvie et al. ..... 108/51.3

FOREIGN PATENT DOCUMENTS

JP 6-115549 * 4/1994

* cited by examiner

*Primary Examiner*—Jose V. Chen
(74) *Attorney, Agent, or Firm*—Alan D. Kamrath; Rider Bennett LLP

(57) ABSTRACT

A paper pallet comprises an upper side and an underside, the upper side having a front end and a rear end. A pair of wheel-receiving compartments is defined in each of the front end and the rear end of the paper pallet for receiving wheels of a four-wheeled motorcycle such that removal of the wheels of the four-wheeled motorcycle during transport is not required.

20 Claims, 5 Drawing Sheets

PAPER PALLET FOR FOUR-WHEELED MOTORCYCLE

BACKGROUND OF THE INVENTION

1. Field of the Invention

The present invention relates to a paper pallet for a four-wheeled motorcycle.

2. Description of the Related Art

A four-wheeled motorcycle such as a four-wheeled beach motorcycle or a four-wheeled motorcycle for off-road use is provided for special surfaces. The wheels of the motorcycles of this type are wider and larger than ordinary ones. In transport, the motorcycle is placed on a planar pallet and then packaged. A forklift is then used to move the packaged pallet and pile it on another packaged pallet. Since the wheels are comparatively wide and large, the pallet may sway and thus impact objects during transport. Further, the wheels are resilient and thus may cause swaying of the motorcycle. Thus, the wheels of the motorcycle are usually removed during transport for reducing the overall height, avoiding the risk of damage and injury. However, removal of the wheels before transport and reassembly of the wheels after arrival in the destination are troublesome.

SUMMARY OF THE INVENTION

An object of the present invention is to provide a paper pallet having four wheel-receiving compartments for receptively receiving four wheels of a four-wheeled motorcycle such that the motorcycle can be transported without removing the wheels.

A paper pallet in accordance with the present invention comprises an upper side and an underside, the upper side having a front end and a rear end. A pair of wheel-receiving compartments is defined in each of the front end and the rear end of the paper pallet for receiving wheels of a four-wheeled motorcycle.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
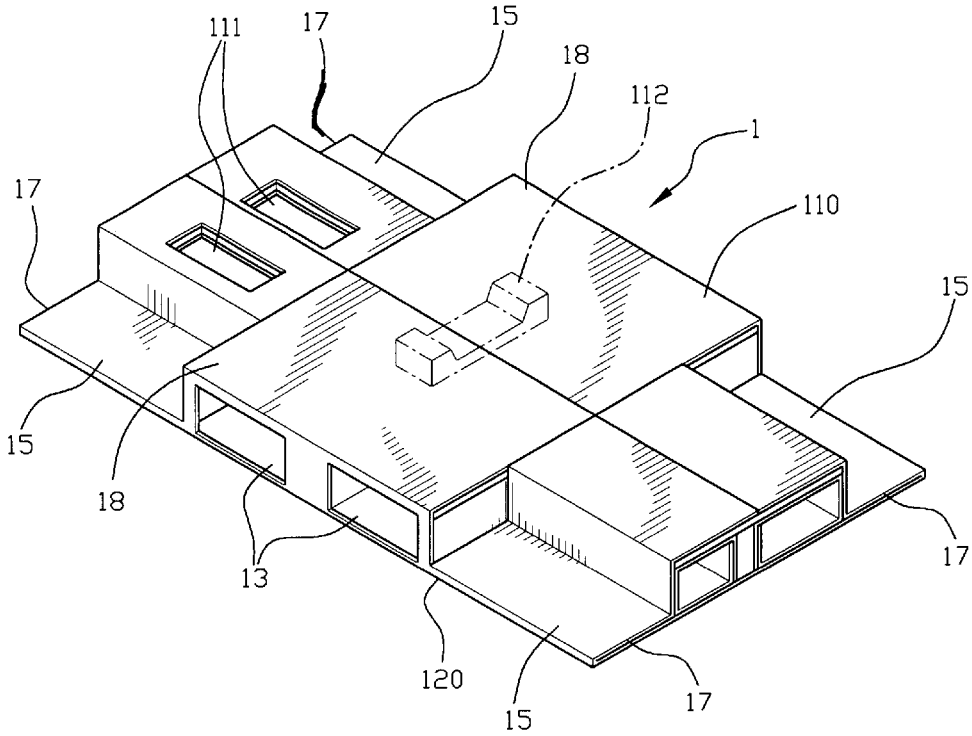
FIG. 1 is a perspective view of a paper pallet in accordance with the present invention.
Figure 2:
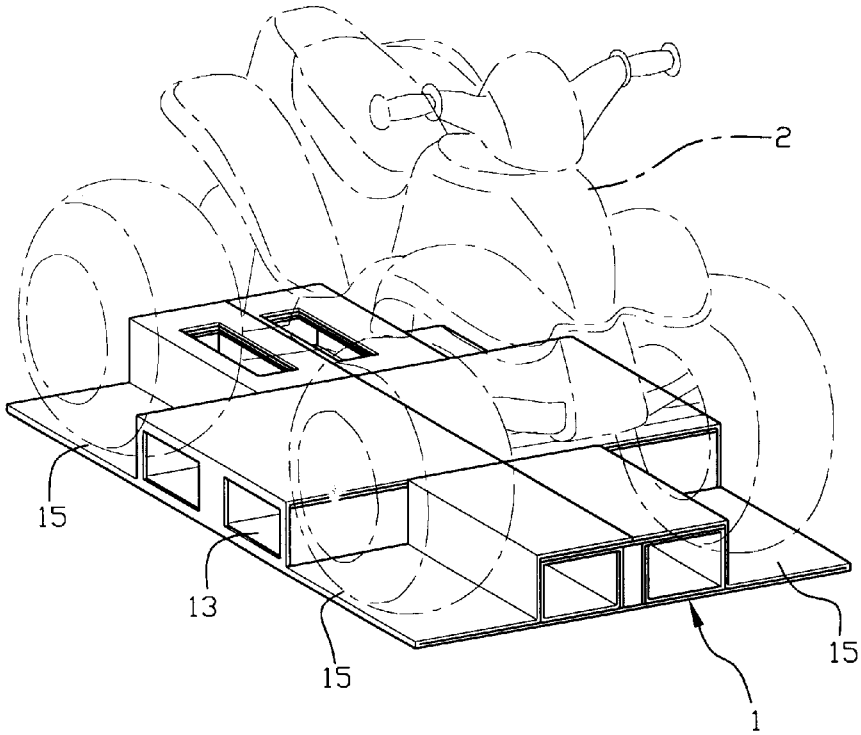
FIG. 2 is a perspective view illustrating use of the paper pallet in accordance with the present invention.

Referring to FIGS. 1 and 2, a paper pallet 1 in accordance with the present invention is provided for supporting a four-wheeled motorcycle and generally comprises an upper side 110 and an underside 120. At least one through-hole 13 (two in this embodiment) is defined between the upper side

110 and the underside 120 and extends along a longitudinal direction or a lateral direction of the paper pallet 1. A pair of wheel-receiving compartments 15 is formed in a front end of the paper pallet 1, and another pair of wheel-receiving compartments 15 is formed in a rear end of the paper pallet 1. Thus, the paper pallet 1 can be used for supporting a four-wheeled motorcycle 2 with the four wheels of the motorcycle 2 being received in the wheel-receiving compartments 15, best shown in FIG. 2. The through-holes 13 of the paper pallet 1 allow the forks (not shown) of a forklift to extend therethrough, allowing the forklift to move the paper pallet 1 to a desired location. The upper side 110 of the paper pallet 1 may include at least one slot 111 (two in this embodiment) or a support member 112. The slots 111 may receive the protruded portion of the four-wheeled motorcycle 2, and the support member 112 may retain a lower portion of the four-wheeled motorcycle 2, thereby securely retaining the four-wheeled motorcycle 2 in place.

Figure 3:
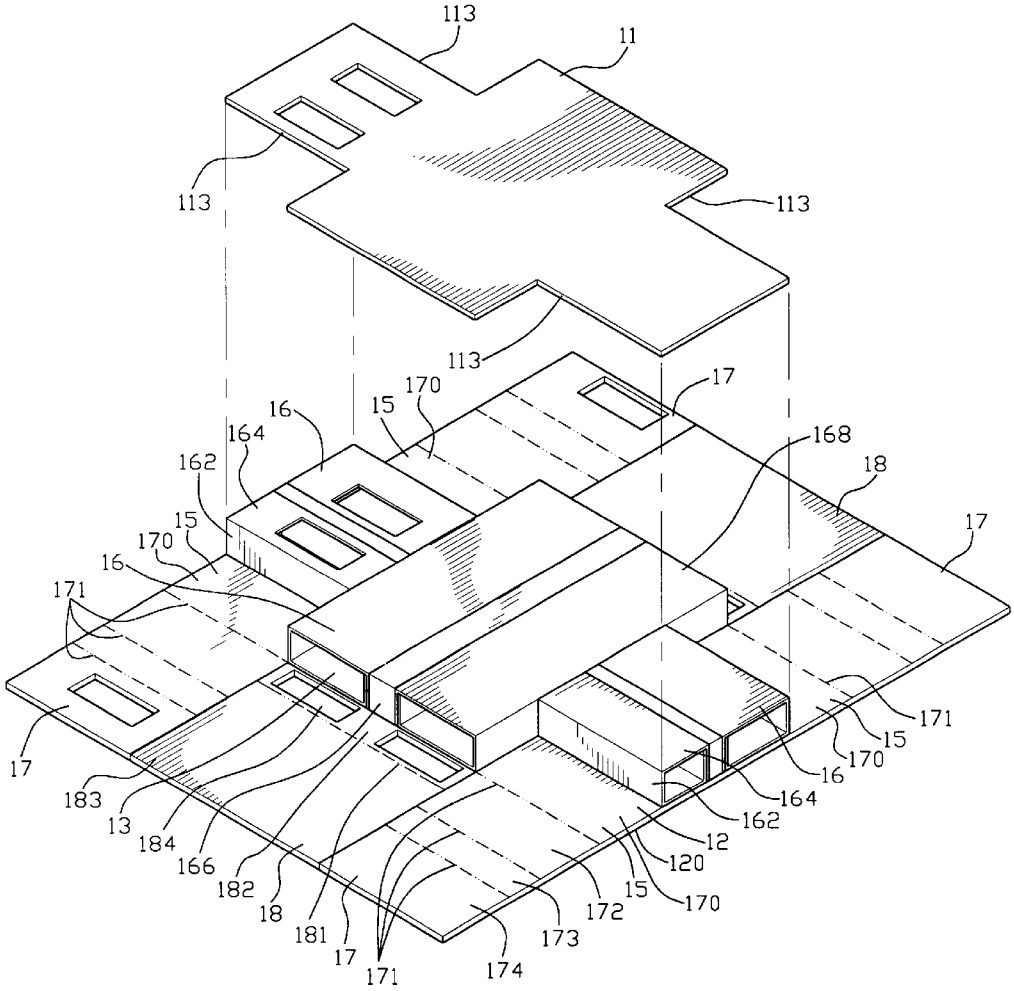
FIG. 3 is an exploded perspective view of the paper pallet in accordance with the present invention, wherein a lower plate of the paper pallet is flattened.

In an embodiment of the invention, the paper pallet 1 comprises an upper plate 11, a lower plate 12, and a plurality of support members 16 sandwiched between the upper plate 11 and the lower plate 12. FIG. 3 is an exploded perspective view of the paper pallet in accordance with the present invention, wherein the lower plate 12 of the paper pallet 1 is flattened.

The upper plate 11 includes four cutouts 13 in each of four corners thereof, the cutouts 13 corresponding to the wheel-receiving compartments 15. Each support member 16 is preferably a rectangular tubular member to thereby define at least one through-hole 13 between the upper side 110 and the underside 120.

The lower plate 2 includes two pairs of flaps 17 in four corners thereof, each flap 17 extending from an associated one of four wheel-receiving sections 170 that delimit the wheel-receiving compartments 15. An enveloping piece 18 is provided between each pair of the flaps 17. Each flap 17 includes three folding lines 171, thereby forming a first enveloping section 172, a second enveloping section 173, and a third enveloping section 174. The first enveloping section 172 is superimposed on the wheel-receiving section 170, the second enveloping section 173 is superimposed on a side wall 162 of the associated support member 16, and the third enveloping section 174 is superimposed on an upper side 164 of the associated support member 16.

Each enveloping piece 18 includes a folding line 181, thereby forming a first enveloping section 182 and a second enveloping section 183. The first enveloping section 182 includes at least one slot 184 and is superimposed on a side wall 166 of an associated support member 16, with the slot 184 being aligned with the through-hole 13 of the associated support member 16. The second enveloping section 183 is superimposed on an upper side 168 of the associated support member 16.

In assembly, the support members 16 are mounted on the supper side of the lower plate 12, leaving four wheel-receiving compartments 15. The upper plate 11 is then placed on the support members 16. Next, the flaps 17 and the enveloping pieces 18 are folded along the folding lines 171 and 181 to form a paper pallet 1.

Figure 4:
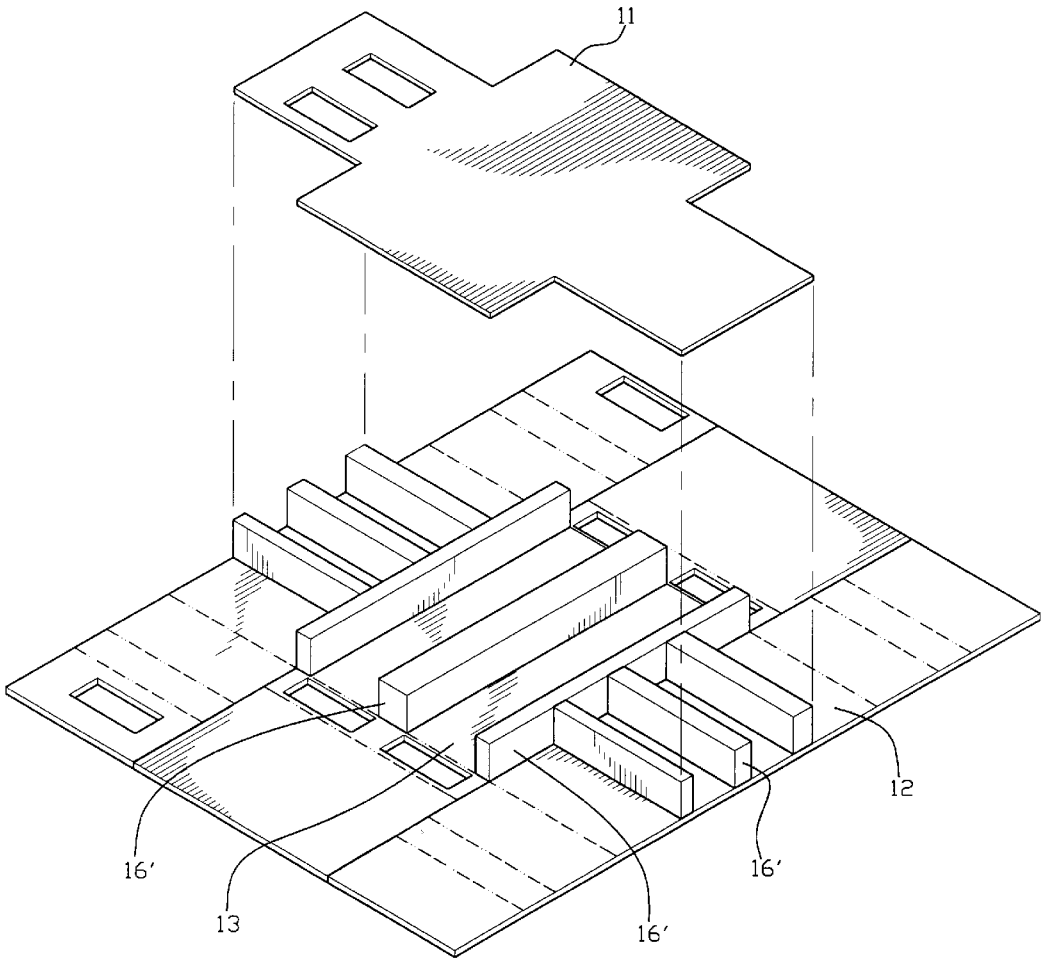
FIG. 4 is an exploded perspective view of a modified embodiment of the paper pallet in accordance with the present invention.

FIG. 4 illustrates a modified embodiment of the invention, wherein the support members are in the form of spaced blocks 16' that define at least one through-hole 13 extending along a longitudinal direction or a lateral direction of the paper pallet 1.

Figure 5:
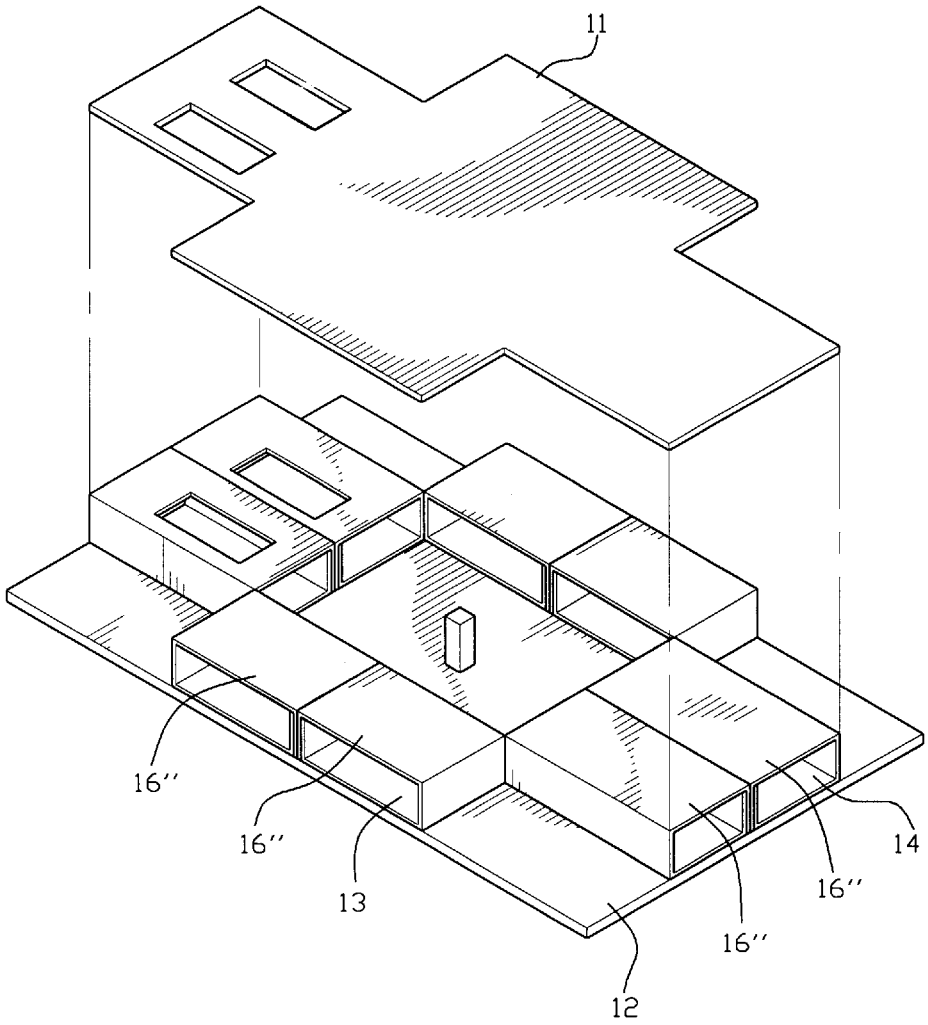
FIG. 5 is an exploded perspective view of another modified embodiment of the paper pallet in accordance with the present invention.

FIG. 5 illustrates another modified embodiment of the invention, wherein the support members (now designated by 16") are arranged in a different manner to define at least one through-hole 13 extending along a lateral direction of the paper pallet 1 and at least one through-hole 14 extending along a longitudinal direction of the paper pallet 1.

Although the invention has been explained in relation to its preferred embodiments, it is to be understood that many other possible modifications and variations can be made without departing from the scope of the invention as hereinafter claimed.

What is claimed is:

1. A pallet for a four-wheeled motorcycle, the pallet comprising an upper side and an underside, the upper side having a front end and a rear end, a pair of wheel-receiving compartments being defined in each of the front end and the rear end of the pallet, the wheel-receiving compartments being adapted to receive four wheels of a four-wheeled motorcycle, the pallet including an upper plate a lower plate, and a plurality of support members securely sandwiched between the upper plate and the lower plate, with the upper plate covering the supporting, members and with the wheel-receiving compartments being defined in four corners of the lower plate that are not covered by the supporting members and the upper plate.

2. The pallet for a four-wheeled motorcycle as claimed in claim 1 formed of paper.

3. The pallet for a four-wheeled motorcycle as claimed in claim 1, wherein the pallet includes at least one through-hole defined between the upper side and the underside, said at least one through-hole being adapted to be extended through by forks of a forklift.

4. The pallet for a four-wheeled motorcycle as claimed in claim 3, formed of paper.

5. The pallet for a four-wheeled motorcycle as claimed in claim 1, wherein the pallet includes at least one first through-hole defined between the upper side and the underside and extending along a longitudinal direction of the pallet, the pallet further including at least one second through-hole defined between the upper side and the underside and extending along a lateral direction of the pallet, said at least one first through-hole and said at least one second through-hole being adapted to be selectively extended through by forks of a forklift.

6. The pallet for a four-wheeled motorcycle as claimed in claim 5, formed of paper.

7. The pallet for a four-wheeled motorcycle as claimed in claim 1, wherein the upper side of the pallet includes at least one slot for receiving a protruded portion of the four-wheeled motorcycle.

8. The pallet for a four-wheeled motorcycle as claimed in claim 7, formed of paper.

9. The pallet for a four-wheeled motorcycle as claimed in claim 1, wherein the upper side of the pallet includes a support member for supporting a lower portion of the four-wheeled motorcycle.

10. The pallet for a four-wheeled motorcycle as claimed in claim 9, formed of paper.

11. The pallet for a four-wheeled motorcycle as claimed in claim 1, wherein each said support member is a rectangular tubular member defining at least one through-hole.

12. The pallet for a four-wheeled motorcycle as claimed in claim 11, formed of paper.

13. The pallet for a four-wheeled motorcycle as claimed in claim 1, wherein the support members are spaced blocks that define at least one through-hole.

14. The pallet for a four-wheeled motorcycle as claimed in claim 13, formed of paper.

15. The pallet for a four-wheeled motorcycle as claimed in claim 1, wherein the lower plate includes four wheel-receiving sections and two pairs of flaps in four corners of the lower plate, each said flap extending from an associated one of the wheel-receiving sections that delimits an associated one of the wheel-receiving compartments, an enveloping piece being provided between each said pair of the flaps, each said flap including three folding fines, thereby forming a first enveloping section, a second enveloping section, and a third enveloping section the first enveloping section of each said flap being superimposed on an associated one of the wheel-receiving sections, the second enveloping section of each said flap being superimposed on a side wall of an associated one of the support members, and the third enveloping section of each said flap being superimposed on an upper side of an associated one of the support members;

each said enveloping piece including a folding line, thereby form a first enveloping section and a second enveloping section, the first enveloping section of each said enveloping piece being superimposed on a side wall of an associated one of the support members, the second enveloping section of each said enveloping piece being superimposed on an upper side of an associated one of the support members.

16. The pallet for a four-wheeled motorcycle as claimed in claim 15, formed of paper.

17. The pallet for a four-wheeled motorcycle as claimed in claim 15, wherein the pallet includes at least one tough-hole defined between the upper side and the underside, said at least one through-hole being adapted to be extended through by forks of a forklift.

18. The pallet for a four-wheeled motorcycle as claimed in claim 17, wherein the first enveloping section of each said enveloping piece includes at least one slot that is aligned with said at least one though-hole.

19. The pallet for a four-wheel motorcycle as claimed in claim 18, formed of paper.

20. The pallet for a four-wheeled motorcycle as claimed in claim 1, wherein the upper plate includes four cutouts in four corners thereof for defining the wheel-receiving compartments.

* * * * *